United States Patent [19]

Armstrong

[11] 4,306,622

[45] Dec. 22, 1981

[54] APPARATUS AND METHOD FOR DOWN-HOLE RETRIEVAL OF PUMPING EQUIPMENT

[76] Inventor: Garland Armstrong, Rte. 2, Box 179, Big Spring, Tex. 79720

[21] Appl. No.: 11,390

[22] Filed: Feb. 12, 1979

[51] Int. Cl.[3] ..... E21B 23/00

[52] U.S. Cl. ..... 166/297; 166/54.5

[58] Field of Search ..... 166/297, 54.5, 55; 294/86.1, 86.24, 99.5

[56] References Cited

U.S. PATENT DOCUMENTS

| | | | |
|---|---|---|---|
| 785,433 | 3/1905 | Phillips | 166/54.5 |
| 1,608,313 | 11/1926 | Helbert | 166/54.5 |
| 1,776,026 | 9/1930 | Hinderlite | 166/54.5 |
| 3,073,388 | 1/1963 | Chenault | 166/54.5 |
| 4,122,899 | 10/1978 | Bayer | 166/297 |

*Primary Examiner*—William F. Pate, III

*Attorney, Agent, or Firm*—M. Norwood Cheairs

[57] ABSTRACT

An apparatus and method for retrieving a downhole pump consisting of using a cylindrical carrier member with a pivoted grasping and severing arm which is on the cylindrical carrier, to grasp and sever the cable connected to the downhole pump to permit retrieval.

7 Claims, 5 Drawing Figures

APPARATUS AND METHOD FOR DOWN-HOLE RETRIEVAL OF PUMPING EQUIPMENT

BACKGROUND OF THE INVENTION

Figure 1:
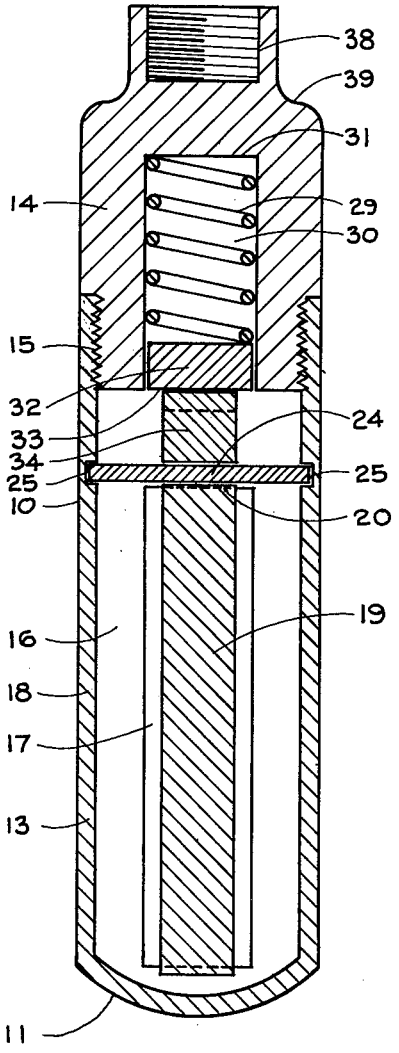

The present invention relates to an apparatus and method for use in the down-hole retrieval of pumping equipment from oil wells. Particularly, the present invention relates to an apparatus and method for cutting connecting cables which connect down-hole pumps in oil wells or other fluid producing wells, to the surface of such wells to thereby facilitate retrieval of said down-hole pump from the bore hole.

Today, particularly with respect to fluid producing wells which pump large quantities of fluid such as large quantities of salt water along with oil, it is common practice to utilize pumps positioned down-hole adjacent the bottom of the well bore or in proximity to the fluid producing strata. Such pumps are disposed down-hole at the end of a tubing string to which they are connected, in order to effect transport of the fluids passing through the pump to the ground surface from which the well bore originates.

These down-hole pumps generally require one or more cables connecting the pump to the surface of the ground. These cables supply power to the pumps and are sometimes supplied for other reasons. Most often, at least one or more of these connecting cables are required for each down-hole pump. These connecting cables extend from the down-hole pump up along the sides of the tubing string from the pump to the surface. The connecting cable is exterior of the tubing and generally is clamped to the tubing in such manner as to keep the cable in a permanent generally taut, position with respect to the tubing. The distance between the clamping devices may vary but usually the clamping devices holding the cable to the tubing will be spaced 10 to 15 feet apart.

On occasion, it becomes necessary to move the down-hole pump from the bottom of the well bore for repair or the cleaning. In many instances, due to sanding up of the lower portion of the well bore or by virtue of corrosion or other occurrence, the down-hole pump becomes rather firmly lodged down-hole and requires extreme pulling forces from the surface in order to dislodge. Also, in other instances, the down-hole pump may actually become disconnected from the tubing, thereby necessitating removal of the tubing and "fishing" for the pump which must then be brought to the surface and reconnected to the end of the tubing. In the course of pulling on the tubing to dislodge the 'stuck" down-hole pump or in pulling disconnected tubing from the well bore in preparation for "fishing" for the pump, it is relatively common that the cable referred to above which run from the pump to the surface, is accidentally broken. Very frequently, the cable is severed at a significant distance above the down-hole pump. In such instance, when the cables are severed, the lower portions of the cable fall in an irregularly coiled heap to the lower part of the well bore and onto the top of the down-hole pump. This coiled cable substantially impedes further removal of the down-hole pump, either by pulling with the tubing or in "fishing" for the down-hole pump. In fact, it usually is necessary to painstakingly remove the coiled cable, sometimes small piece by piece, in order to removal the down-hole pump or even get to it. This, of course, is relatively expensive and results in considerable down-time for the well, which in turn results in the loss of much needed production.

In addition to the cable severing and coiling down-hole on top of the pump, quite frequently, the clamping devices themselves are broken in the course of trying to pull the tubing string. The clamping devices which are usually Monel bands, also when broken, fall down upon the top of the pump. Removal of these broken clamping devices is also necessary before the pump can be removed. This removal is also slow and painstaking and thus, costly.

It is now an object of the present invention to provide an apparatus and method whereby the removal of down-hole pumps in well bores of fluid producing wells may be facilitated.

Another object of the present invention is to provide a new apparatus and method for preventing cables connecting down-hole pumps in well bores of fluid producing wells, to the surface of said fluid producing wells, and clamping devices holding said cables, from becoming coiled and piled upon the top of said down-hole pump in operations whereby it is necessary and desirable to remove said down-hole pump to the surface.

More particularly, the present invention is an apparatus and method for cutting cables attached to down-hole pumps in fluid producing wells which cables connect such pumps to the ground surface of the fluid producing well, such cutting being adjacent to the top of said down-hole pumps to thereby prevent the problem of such cables being severed at a point further distant from the top of said down-hole pump and falling in a coiled position on top of said down-hole pump, and the further problem of clamping devices holding said cables to the tubing string from becoming severed and falling on top of said down-hole pumps.

Additional objects will become apparent from the following description of the invention herein disclosed.

The present invention which fulfills the above and other objects, is, in one of its embodiments, an apparatus for severing cables connecting down-hole pumps in fluid producing wells to the surface of said fluid producing wells, said apparatus comprising (1) a cylindrical carrier member of a size to be accommodated within a tubing string in slidable and rotatable contact with the interior walls of said tubing string, (2) at least one cable grasping and severing member extending downward from a central section of the interior of said cylindrical carrier and rotatably affixed to said central section of said cylindrical carrier such as to permit rotation of said grasping and severing member through a vertical plane; (3) a vertical slotted opening in said cylindrical carrier for each of said grasping and severing members, such slotted opening being positioned such that the lower portion of said grasping and severing member may rotate in a vertical direction through said slotted opening and with the upper edge of said slotted opening being located below the rotational connection of said grasping and severing member of said cylindrical carrier to thereby limit said grasping and severing member from rotating in said vertical direction through more than 90 degrees from the vertical axis of said carrier member, (4) a tension producing means positioned within an internal portion of said carrier such as to exert force on said grasping and severing member such as to cause the lower portion thereof to rotate in a vertical direction, and (5) means for connecting said cylindrical carrier to a connecting means connecting said cylindrical carrier to the ground surface of said fluid producing well.

In another embodiment, the present invention is a method for severing connecting cables connecting down-hole pumps in fluid producing wells to the ground surface of said fluid producing wells, said severing taking place adjacent the top of said down-hole pump, said method comprising, (1) introducing a means of cutting the walls of the tubing string of said fluid producing well, into the tubing string under conditions such that the walls of said tubing string is cut adjacent the top of said down-hole pump, (2) pulling said tubing string vertically to separate the cut apart edges of said tubing a distance such as to accommodate the outward extension of the severing means of an apparatus for severing connecting cables connecting down-hole pumps in fluid producing wells to the ground surface of said fluid producing wells, but not pulling said tubing string vertically to such extent as to cause said connecting cables to sever, (3) introducing into said tubing string an apparatus for severing said connecting cables, said apparatus comprising that hereinabove described, (4) lowering said apparatus down through said tubing string until said apparatus reaches the opening between said upper and lower portions of said cut apart tubing string, whereupon said severing member is extended out through said opening to an open extension of no greater than 90 degrees from the vertical axis of said apparatus, (5) rotating said severing apparatus such that said severing member is brought into contact with a said connecting cable with sufficient force to cause said severing member to firmly engage said connecting cable, and (6) pulling said severing apparatus upward such that said cable is brought against the lower edge of said cut tubing string by said severing member with sufficient force to cause said cable to be cut.

By means of the present invention in its various embodiments, the connecting cable between down-hole pumps in fluid producing wells and the surface of said fluid producing wells is severed just above the down-hole pump, thereby alleviating the costly and time consuming problem of removing said cable when such are broken further above said down-hole pumps as above discussed and the problem of broken clamping devices piling on top of said down-hole pumps. While the description of the present invention as herein presented is directed primarily to use in oil wells, it is clearly within the scope of the present invention that it may be used with respect to any well bore holes having down-hole pumps which require cables connecting said pumps to the surface and further, require tubing strings to bring the fluid being pumped to the surface.

FIG. 1 of the drawings is a longitudinal cross section of the apparatus of the present invention.

Figure 2:
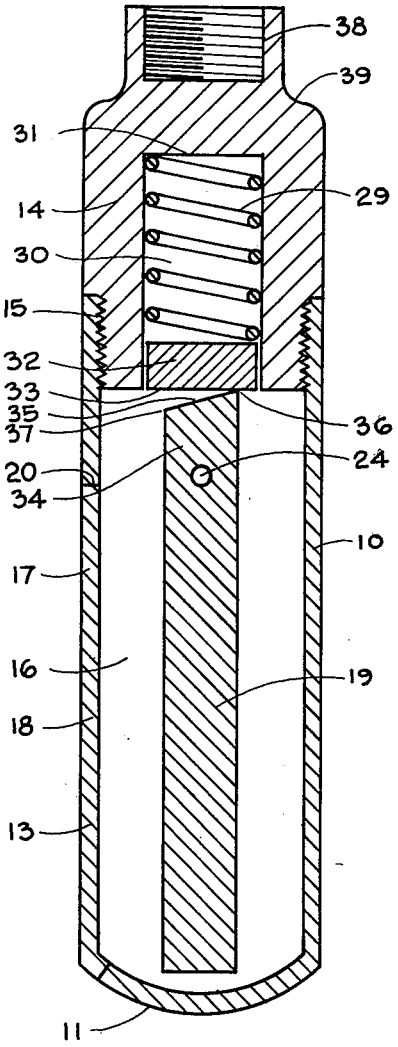

FIG. 2 of the drawings if a longitudinal cross section of the apparatus of the present invention at a 90° relation to the cross section of FIG. 1.

Figure 3:
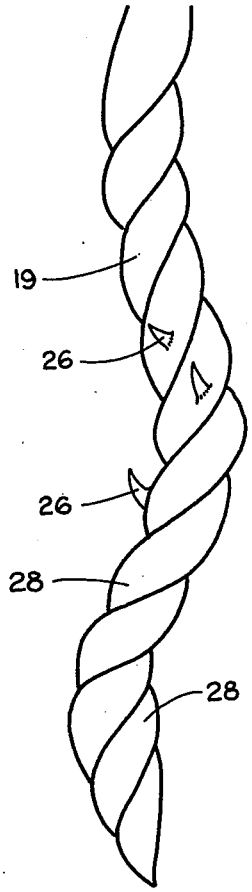

FIG. 3 of the drawings is a detail of the apparatus of the present invention.

Figure 4:
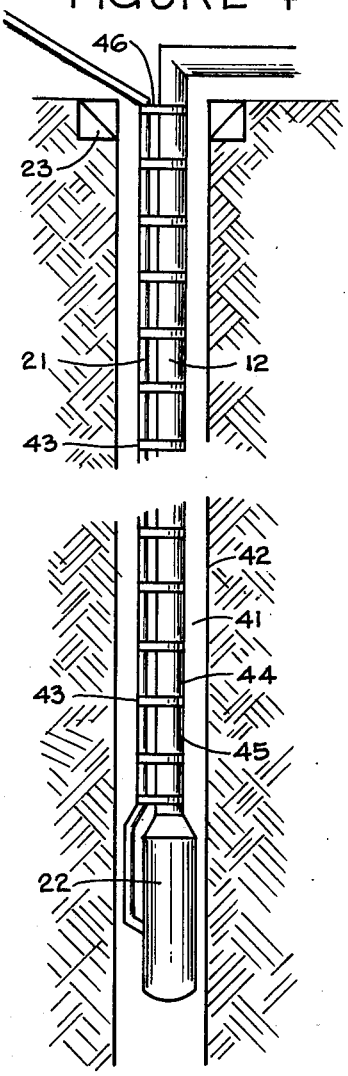

FIG. 4 of the drawings is a schematic drawing illustrating the connection of tubing to a down-hole pump in a well bore hole and illustrating the connecting cables connecting said down-hole pump to the surface.

Figure 5:
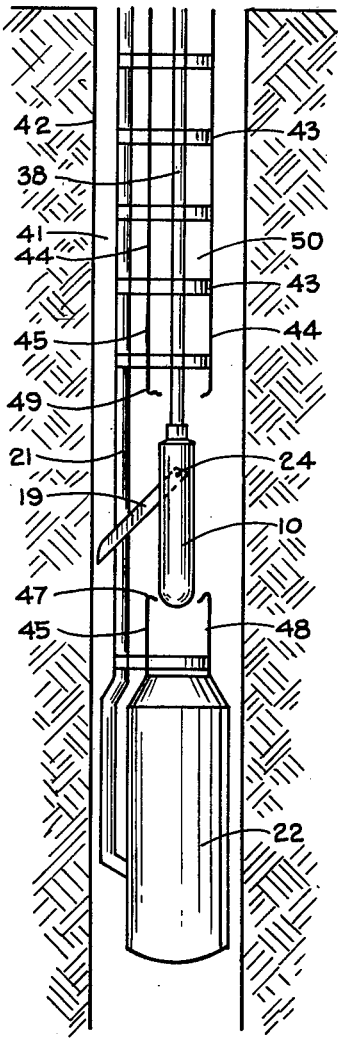

FIG. 5 of the drawings is a schematic drawing similar to FIG. 4 but showing the tubing string severed and the cable severing apparatus of the present invention in position for severing said cables.

In order to more specifically define and describe the present invention, reference shall be made to the accompanying drawings. In the drawings, the same characters shall be used throughout to designate like features in said drawings.

Referring to the drawings, more particularly to FIGS. 1, 2 and 3, the present invention includes a carrier member or body 10. Said carrier body 10 is most desirably constructed of a stainless steel material, although it is possible to use other materials. At least the lower end 11 of carrier body 10 is preferably rounded or pointed as shown in FIG. 1 to facilitate its introduction into and its travel through the tubing string 12. In order to facilitate the positioning of the remaining parts of the apparatus within carrier body 10, as hereinbelow more particularly discussed, it is somewhat desirable that carrier body 10 be constructed of a lower section 13 and an upper section 14 which are connected by means of threads 15 of lower and upper sections 13 and 14. Carrier body 10 is generally cylindrical in shape and is sized such as to fit within and in slidable positioning with respect to the interior walls of tubing string 12.

The carrier body 10 generally contains an internal open chamber 16 which has at least one slot 17 in the wall 18 thereof. Slot(s) 17 opens between chamber 16 and through wall 18 to the outside of the carrier body 10. The number of slots 17 may vary depending on the particular embodiment of the invention employed as is more fully discussed below. However, seldom if ever will more than two such slots 17 be utilized with only one such slot being much more common.

Slot(s) 18 will be of a width and length sufficient to permit severing member or arm 19 to extend from its "at rest" position as more fully described below, through said slot 17 to a position no greater than 90 degrees from the vertical axis of said carrier body 10. Limitation of rotation of severing arm 19 to said no greater than 90 degree position may be carried out by means of positioning of the upper edge 20 of slot 17 with respect to the rotational axis of severing arm 19 such that the rotation of said severing arm 19 is stopped at no greater, preferably less, than 90 degrees from the vertical axis of carrier body 10 by means of severing arm 20 coming in contact with said upper edge 20.

Within carrier body 10 is positioned severing arm 19, which, as will be more fully described hereinafter, acts to grasp and sever the connecting cable 21 which connects down-hole pump 22 with the earth surface 23 of an oil well or similar fluid producing bore hole. Severing arm 19 is pivotally mounted within carrier body 10 by means of pivotal pin 24 which extends through an upper portion of severing arms 19 and is connected at each end to a pivotal pin securing base 25. It is upon and around this pivotal pin 24 that severing arm 19 rotates from within carrier body 10 through slot 17 to its extended position for grasping and severing connecting cable 21 which connects the down-hole pump 22 and the surface 23. The shape of severing arm 19 may take many forms. A particularly useful form is that shown in FIG. 3 in which severing arm 19 is shown as a twisted, helically grooved bar with a somewhat S or repeating S configuration. Such a useful embodiment of severing arm 19 is generally made of a square rod. Preferably, severing arm 19 will have spaced apart barb-like extensions protruding from the surface thereof, particularly toward the outer end thereof. Such barbs 26 are preferably somewhat curved back toward carrier body 10 to provide a "hooking" action on the connecting cables.

The above described shape has the advantage that upon rotation of the severing arm 19 into contact with a cable 21, such cable is caught by the groove 27 and barbs 26 of said severing arm 19 and is thereby firmly held by said severing arm 19. By so firmly holding cable 21, further rotation of severing arm 19 results in cable 21 being pulled taut and against the edges 28 of severing arm 19 such that said cable 21 may be pulled upward upon the upward movement of carrier body 10. Of course, it is readily understood by those skilled in the art that many modifications and/or alternate designs of severing arm 19 may be made and yet said severing arm 19 be effective in severing cables 21. The embodiment shown is merely intended to be exemplary of a particular useful embodiment but is not to be considered as limiting.

In order to force severing arm 19 through slot 17 when said carrier body 10 enters into a region having open space surrounding it, a spring 29 along with attendant apparatus, as is more fully described hereinafter, is provided to cause the lower end of severing arm 19 to be formed outward through slot 17 to its maximum extendable position or to the maximum extension permitted by the confines of said open space. Spring 29, as shown in the drawing, is compressed within a cylindrical chamber 30 between an upper end 31 of said cylindrical chamber 30 and a pressure plate 32 slidably positioned within the lower end of said cylindrical chamber 30. The lower face 33 of pressure plate 32 is a flat surface lying in a plane substantially perpendicular to the vertical axis of said carrier body 10.

The upper end 34 of severing arm 19 which extends above pivotal pin 24 has a tapered flat surface 35, the upper edge 36 which is in contact with the lower face 33 of pressure plate 32 with said upper edge 36 touching said lower face 33 at a point off center to the vertical axis of said pressure plate 32 and on the side of said vertical axis opposite from the side on which is positioned the lower edge 37 of upper surface 35 or upper end 34 of severing arm 19.

By the above described arrangement of spring 29 within cylindrical chamber 30 in compression against pressure plate 32, force is consistently exerted against pressure plate 32 to drive it downward. Such downward force exerted against offset upper edge 36 of the tapered upper surface 35 of severing arm 19 causes severing arm 19 to rotate on pivotal pin 24 until upper surface 36 and lower face 34 form a continuous surface contact or until severing arm 20 has rotated into contact with the upper edge 21 of slot 17 or the outer end of severing arm 20 has come into contact with the walls of the bore hole, whichever occurs first. Of course, to use this type of spring action, precision machining is necessary with respect to the walls of cylindrical chamber 31 and pressure plate 33 and the lower face 34 of pressure plate 33 and the upper surface 36 and upper edge 37 of upper end 35 of severing arm 20.

It can be readily understood by those skilled in the art that there are many means by which force can be exerted upon severing arm 19 to cause its rotational extension outward through slot 17. Springs directly pushing or pulling on severing arm 19 above or below pivotal pin 24 can be employed. Additionally, tension producing means other than springs could be employed instead of said springs. Knowing the purpose of the tension producing means employed in the present invention as herein described, the design and use of other tension producing means other than that specifically described herein, is readily within the skill of the art and such use would be within the spirit and scope of the present invention.

To provide a means for attaching a surface to cutting tool connecting means to the carrier body 10 of the present invention, an attaching means 38 is affixed to the top surface 39 of carrier body 10. The attaching means shown in the drawings is for the threaded attachment of small drill pipe or sucker rods. Of course, other attachment means could be used as well depending on the type of connecting means which is utilized to connect carrier body 10 to earth surface 23. Rods such as sucker rods, could be used which would necessitate a threaded attachment means on the top surface 39 of carrier body 10. The type of attaching means used is well within the skill of the art and whatever the attaching means, it is within the spirit and scope of the present invention.

Referring now more particularly to FIGS. 5 and 6, a method of facilitating the removal of down-hole pump 22 from the lower portion of a fluid producing bore hole is described. Referring to these drawings, down-hole pump 22 is shown positioned at a lower end of a tubing string 12 within a casing lined bore-hole 41 which is for the production of an under-surface stored fluid. Bore-hole 41 has walls 42 (the casing) which defines the circumferences of the generally cylindrical bore-hole 41. Connecting down-hole pump 22 to the ground surface 23 is a connecting cable 21. While only one connecting cable is illustrated, it is to be understood that the number may vary depending upon the particular down-hole pump utilized. It is possible that such connecting cables may number as few as one, which is generally the case, or as many as three or more. For purposes of the present description, however, only one connecting cable will be referred to.

The purpose of connecting cable 21 is to provide power to and otherwise facilitate the operation of down-hole pump 22. In order to maintain the connecting cable 21 in an aligned position, a series of clamps 43 is provided to affix connecting cable 21 to the exterior wall 44 of tubing string 12. Generally, clamps 43 are spaced apart by about 10 to 15 feet though this distance is a matter of choice to the operator and may vary either way from closer together to farther apart.

To initiate the method of the present invention, a means for cutting the walls 45 of the tubing string 12 is introduced into the upper end 46 of said tubing string 12. The means for cutting the tubing string may comprise any conventional method ranging from chemical means such as acids to any mechanical means. The introduction of such cutting means is under conditions and is so controlled as to effect a cutting of the tubing string 12 as nearly adjacent the top surface 39 of down-hole pump 22 as is within control. The use of such cutting means is conventional as to its type, control of depth, etc. and thus, needs no further description, it being well within the skill of the art.

The tubing string 12 is cut adjacent the top surface 39 of down-hole pump 22. With respect to chemical cutting means, this means nothing more than waiting the calculated time for the chemical to eat through the tubing. With regard to mechanical cutting means, then cutting is effected by whatever means employed.

When the tubing string 12 has its walls 45 cut, by whatever means employed, adjacent to top surface 39 of down-hole pump 22, then the apparatus hereinabove described is introduced into the tubing string 12 and lowered by means of its surface to apparatus connecting means 38 to a position such that the lower end of slot 17 is above the upper edge 47 of the lower remaining section 58 of tubing string 12 which should be approximately adjacent the top surface 39 of down-hole pump 22.

After tubing string 12 is cut, it is pulled vertically to separate the lower cut edge 49 of the upper remaining section 50 from the upper edge 47 of the lower remaining segment of such tubing string 12. Care is taken to pull such tubing string 12 no more than necessary to allow the above described apparatus to operate, and special care is exercised to not pull the tubing string 12 sufficiently to cause the connecting cable 21 to sever or the clamps 43 to break. Generally, tubing string 12 may be pulled vertically up to four feet without severing the connecting cable 21 or clamps 44. Thus, tubing string 12 may be raised vertically in the bore hole 41 until the connecting cable 21 becomes taut but not pulled apart. Such careful handling of the vertical pulling of the tubing string 12 is within the skill of the art and requires no further elaboration herein.

It should be noted and understood that though the present invention is described in terms of introduction of the apparatus of the present invention before pulling the severed sections of the tubing string 12 apart, this is not a required order of procedure. The apparatus of the present invention can be introduced before or after the sections of the severed tubing string 12 are pulled apart. Either method of operation is within the spirit and the scope of the present invention and will depend upon the operator and other possible circumstances of the particular situation.

Once the apparatus of the present invention as hereinabove described, is lowered into the opening between the upper section 50 of tubing string 12 and the lower section 48 of said tubing string 12, such that the lower end of slot 17 is above the upper edge 47 of the lower remaining section 48 of tubing string 12 which is still attached to down-hole pump 22, then severing arm 19 will be forceably extended by means of spring 29 and its attendant force conveying means, through a vertical plane until the outer ends of such severing arm 19 comes in contact with the walls 42 of bore-hole 41 or until its extension is limited by the upper edge 20 of slot 17 or limited by the meeting of the lower face 33 of pressure plate 32 with the upper surface 35 of the upper end 34 of severing arm 19. Such extension will place severing arm 19 in a position such that rotation of carrier body 10 will cause severing arm 19 to contact connecting cable 21.

Carrier body 10 is then rotated by means of rotating connecting means 38 from ground surface 23 by means within the skill of the art, while maintaining tubing string 12 in a fixed position. Rotation of carrier body 10 results in severing arm 19 also rotating and thereby engaging connecting cable 21 with which it comes in contact during its rotation. By applying sufficient force to the rotation of carrier body 10, and thus to severing arm 19, connecting cable 21 is firmly grasped by severing arm 19.

After cable 21 has been firmly grasped by severing arm 19, carrier body 10 is pulled upward. Such pulling is carried out such as to cause severing arm 19 to rotate downwardly back toward carrier body 10 while still maintaining a firm engagement with connecting cable 21. This results in connecting cable 21 being brought into contact with the lower edge 49 of upper section 50 of tubing string 12. Upon the application of additional upward pulling force on carrier body 10, connecting cable 21 is cut by lower edge 49 of upper section 50 of tubing string 12. Such cutting of connecting cable 21 adjacent to the top end of down-hole pump 22 results in the lower severed segment of connecting cable 21 being sufficiently short that it does not interfere with the "fishing" of the down-hole pump 22 from the well bore-hole 41.

What is claimed is:

1. An apparatus for severing cables connecting down-hole pumps in fluid-producing wells to the surface of said fluid-producing wells, said apparatus comprising (1) a cylindrical carrier member of a size to be accommodated within a tubing string in slidable and rotatable contact with the interior walls of said tubing string, (2) at least one cable grasping member extending downward from a central section of the interior of said cylindrical carrier and rotatably affixed to said central section of said cylindrical carrier such as to permit rotation of said grasping member through a vertical plane, (3) a vertical slotted opening in said cylindrical carrier for each of said grasping means, such slotted opening being positioned such that the lower portion of said grasping member may rotate in a vertical direction through said slotted opening and with the upper edge of said slotted opening being located below the rotational connection of said grasping member of said cylindrical carrier to thereby limit said grasping member from rotating in said vertical direction to more than 90°, (4) a tension producing means positioned in an internal portion of said carrier such as to exert force on said grasping member such as to cause the lower portion thereof to rotate in a vertical direction, and (5) means for connecting said cylindrical carrier to a connecting means connecting said cylindrical carrier to the ground surface of said fluid-producing well.

2. The apparatus of claim 1 wherein said grasping member is a twisted helically grooved bar with an S and/or repeating S configuration.

3. The apparatus of claim 2 wherein said grasping member contains pointed barbs at the outer extremities thereof to further facilitate grasping said cables.

4. The apparatus of claim 1 wherein said tension producing means is a spring.

5. A method for severing cables connecting down-hole pumps and fluid-producing wells to the ground surface of sid fluid-producing wells, said severing taking place adjacent to top of said down-hole pump, said method comprising, (1) introducing a means of cutting the walls of the tubing string of said fluid-producing well, into the tubing string under conditions such that the wall of said tubing string is cut adjacent to the top of said down-hole pumps, (2) pulling said tubing string vertically to separate the cut-apart edges of said tubing a distance such as to accommodate the outward extension of the grasping means of an apparatus for severing said connecting cables, but not pulling said tubing strings vertically to such extent as to cause said connecting cables to sever, said apparatus comprising (a) a cylindrical carrier member of a size to be accommodated within a tubing string in slidable and rotatable contact with the interior walls of said tubing string, (b) at least one cable grasping member extending downward from a central section of the interior of said cylindrical carrier and rotatably affixed to said central section of said cylindrical carrier such as to permit rotation of said grasping member through a vertical plane, (c) a vertical slotted opening in said cylindrical carrier for each of said grasping means, such slotted opening being positioned such that the lower portion of said grasping member may rotate in a vertical direction through said slotted opening and with the upper edge of said slotted opening being located below the rotational connection of said grasping member of said cylindrical carrier to thereby limit said grasping member from rotating in said vertical direction to more than 90°, (d) a tension producing means positioned in an internal portion of said carrier such as to exert force on said grasping members such as to cause the lower portion thereof to rotate in a vertical direction, and (e) means for connecting said cylindrical carrier to a connecting means connecting said cylindrical carrier to the ground surface of said fluid-producing well, (3) introducing into said tubing string said apparatus for severing said connecting cables, (4) lowering said apparatus through said tubing string until said apparatus reaches the opening between said upper and lower section of the cut-apart tubing string, whereupon the grasping arm of said apparatus is extended out through said opening to an open extension no greater than 90 ° from the vertical axis of said apparatus, (5) rotating said severing apparatus such that said grasping arm is brought into contact with said connecting cables with sufficient force to cause such grasping arms to firmly engage said connecting cables, and (6) pulling said severing apparatus upward such that said cables are brought into contact with the lower edge of the upper section of said tubing string by said grasping arm with sufficient force to cause said cables to be cut.

6. The method of claim 5 wherein only one cable connects said down-hole pump to said ground surface.

7. The method of claim 5 wherein steps (2) and (3) are reversed.

* * * * *